US005961289A

United States Patent [19]

Lohmann

[11] Patent Number: 5,961,289

[45] Date of Patent: Oct. 5, 1999

[54] COOLING AXIAL FLOW FAN WITH REDUCED NOISE LEVELS CAUSED BY SWEPT LAMINAR AND/OR ASYMMETRICALLY STAGGERED BLADES

[75] Inventor: Dieter Lohmann, Braunschweig, Germany

[73] Assignee: Deutsche Forshungsanstalt fur Luft-und Raumfahrt e.V., Cologne, Germany

[21] Appl. No.: 08/562,145

[22] Filed: Nov. 22, 1995

[51] Int. Cl.[6] ..... F04D 29/36

[52] U.S. Cl. ..... 416/189; 416/242; 416/DIG. 2; 416/DIG. 5

[58] Field of Search ..... 416/169 A, 189, 416/242, 179, DIG. 2, DIG. 5

[56] References Cited

U.S. PATENT DOCUMENTS

| | | | |
|---|---|---|---|
| 4,358,245 | 11/1982 | Gray . | |
| 4,548,548 | 10/1985 | Gray, III | 416/189 R |
| 4,569,631 | 2/1986 | Gray, III | 416/169 A |
| 4,915,588 | 4/1990 | Brackett | 416/242 |
| 5,064,345 | 11/1991 | Kimball . | |
| 5,244,347 | 9/1993 | Gallivan et al. | 416/169 A |
| 5,273,400 | 12/1993 | Amr | 416/DIG. 5 |

FOREIGN PATENT DOCUMENTS

| | | | |
|---|---|---|---|
| 0557239 | 8/1993 | European Pat. Off. | 415/220 |
| 3 137 114 | 10/1991 | Germany . | |
| 2217789 | 11/1989 | United Kingdom | 416/242 |
| 90/15253 | 12/1990 | WIPO . | |

*Primary Examiner*—Christopher Verdier
*Attorney, Agent, or Firm*—Salter & Michaelson

[57] ABSTRACT

An axial fan for a cooling blower of a vehicle engine has fins with leading and trailing edges, and aeroacoustic optimization is provided by each of the leading edges and trailing edges having a strong forward sweep followed by a strong backward sweep in the manner of a bird's wing or by a straight forward sweeps followed by a strong backward sweep.

18 Claims, 5 Drawing Sheets

COOLING AXIAL FLOW FAN WITH REDUCED NOISE LEVELS CAUSED BY SWEPT LAMINAR AND/OR ASYMMETRICALLY STAGGERED BLADES

BACKGROUND OF THE INVENTION

This invention relates to an axial fan and especially to an electrically driven fan comprising a fan wheel with blades or fins, the tips of the fins being connected to a surrounding ring.

Such fans are known to be used in blowers of water-cooled vehicle engines, the blowers being arranged between the radiator and the engine unit. Fresh air is sucked in by means of the fan wheel, passed through the radiator and discharged to the exterior. The normal practice is to take the cooling air axially through the fan wheel; it passes first into a space between the fan wheel and the engine unit, where it is discharged radially.

Not only does the designer of such axial fans have to meet high requirements nowadays in respect of technical data such as generation of pressure of efficiency; but physiological aspects such as noise nuisance also have to be considered increasingly, thus making the requirements still more complex.

The noises from these fans consist mainly of the broad band or virtex noise and the particularly penetrating sound of the fan, the frequency of which corresponds to the product of the fan wheel speed and the number of fins. A reduction in the noise has been achieved by arranging the fins at unequal intervals on the hub of the fan wheel. Although this has diminished the unpleasant sound of the fan it has adversely affected flow conditions.

SUMMARY OF THE INVENTION

The present invention seeks to provide an axial fan with a fan geometry which is considerably quieter than in known fans without sacrificing its thrust and efficiency. The invention must also avoid rolling-up or coiling eddies at the leading edges of the blades or fins, which affect performance, efficiency and noise, and separations in the hub region induced by steep pressure gradients.

Accordingly, the present invention provides an axial fan comprising a fan wheel with fins with inner and outer ends and leading and trailing edges, the inner ends of said fins being fixed to a hub and the outer ends of the fins being fixed to a surrounding ring arranged concentrically with said hub, wherein the leading edges and trailing edges of the fins each have a strong forward sweep followed by a strong backward sweep in the manner of a bird's wing.

In a preferred embodiment, transitions are formed between the forward sweeps and the backward sweeps at the leading edges and trailing edges of the fins, said transitions being formed in their central regions by constant azimuthal displacements. The transitions may comprise cubic splines.

Preferably the fins have profiles defining a chord length, the chord length being shorter in the vicinity of the hub than at the outer ends of the fins. The chord length in the middle region of the fins may be unchanged.

Preferably the fins define a torsion angle, said torsion angle being larger in the vicinity of the hub than in the vicinity of the outer ends of the fin blades. The torsion angle may be between about 45° at the inner end of the fins and about 15° at the outer end of the fins.

Preferably each particular section of a fin profile defines a sweep or sickle angle, said sickle angle increasing from the hub to the middle region of the fin, then decreasing towards the outer end of the fin. The sickle angle may be about 0° at the hub, about 30° midway along the fin and about 7° at the outer end.

The fins may be rounded at their leading edges.

The axial fan of the invention is distinctive in the fact that the aerodynamics and acoustics of the fan are optimised simultaneously. A fan geometry has been created in the process in the form of a blade swept forwards and backwards, the rolling-up eddy and induced separations at the fins being affected in such a way that there is no loss of thrust and efficiency.

BRIEF DESCRIPTION OF THE DRAWINGS

Preferred embodiments of the present invention will now be described in greater detail by way of example only, with reference to the accompanying drawings, of which.

DESCRIPTION OF THE PREFERRED EMBODIMENT

Figure 1:
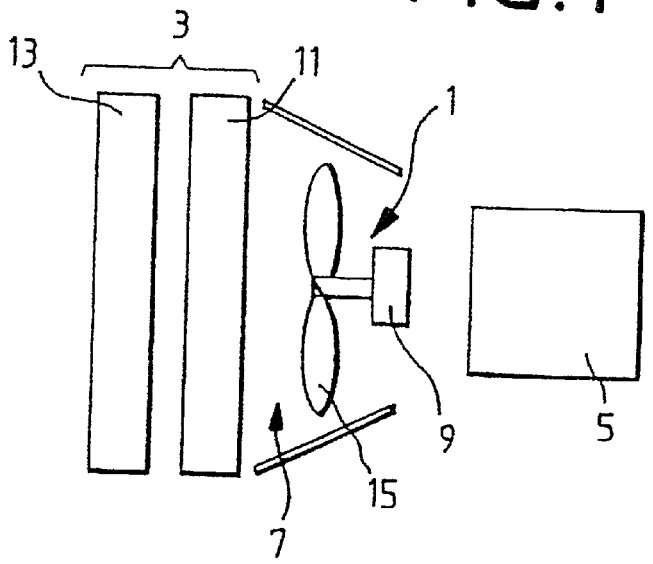
FIG. 1 is a diagrammatic side view of an axial fan for a motor vehicle.

Referring now to the drawings, FIG. 1 is a diagrammatic side view of an axial fan 1 inserted e.g. in a cooling blower 3 in front of a vehicle engine 5. A fan wheel 7 is driven in known manner by an electric motor 9. The cooling blower 3 comprises a radiator 11 and a condenser 13 arranged in front of it.

The invention also covers use of the axial fan 1 in other industrial fields.

Figure 2:
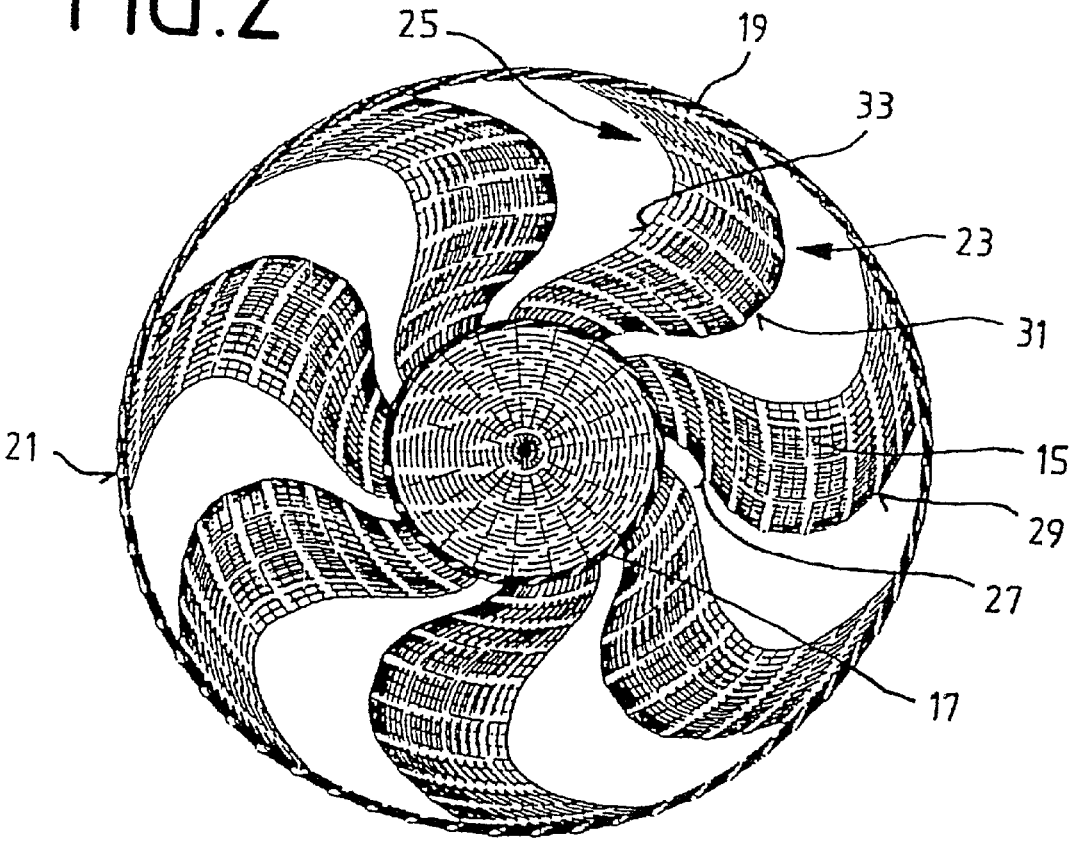
FIG. 2 is a plan view of the fan wheel.
Figure 3:
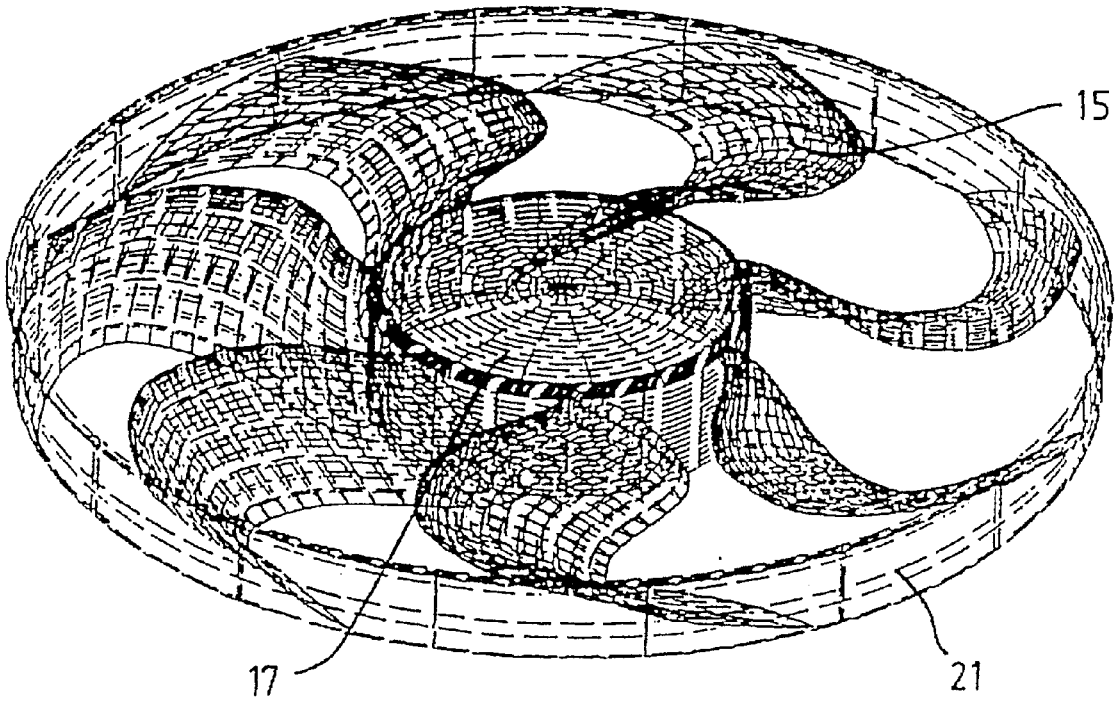
FIG. 3 is a graphical representation of the fan wheel.

FIG. 2 shows the fan wheel 7 in plan; the inner ends of its sickle-shaped or crescent-shaped blades or fins 15 are fixed to a hub 17 driven by an electric motor, and the tips 19 of the fins are fixed to a housing or jacket or surrounding ring 21 arranged concentrically with the hub 17.

The leading edges 23 and trailing edges 25 of the three-dimensional fins each have a highly or strong forward sweep 27 followed by a highly or strong backward sweep 29 as compared to a planar member. The transitions from the forward sweeps 27 to the backward sweeps 29 at the leading edges 23 and trailing edges 25 of the fins are formed in their central regions by constant azimuthal displacements. These reliefs of the sweeps ensure that rolling-up or coiling eddies at the leading edges 23 are avoided. In an advantageous embodiment the transitions comprise relatively straight transition portions or cubic splines 31 and 33. It will also be seen from FIG. 2 and Table 1 below that the chord length C of the fin profiles is shorter in the region of the hub 17 than at the tips 19 of the fin blades. The blade or torsion angle beta in the vicinity of the hub 17 is also larger than in the vicinity of the tips 19. Thus the blade or torsion angle beta at the root of the blade or the hub 17 may, for example, be approximately 45 degrees, while the torsion angle $\omega\beta$ at the blade tips 19 is approximately 15 degrees.

Figure 4:
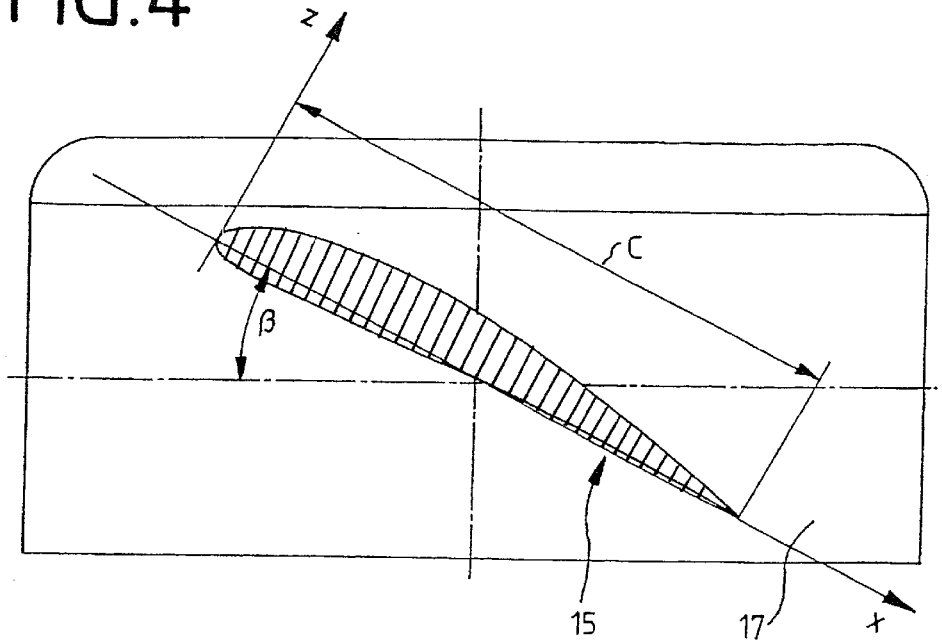
FIG. 4 is a section through a fin.
Figure 6:
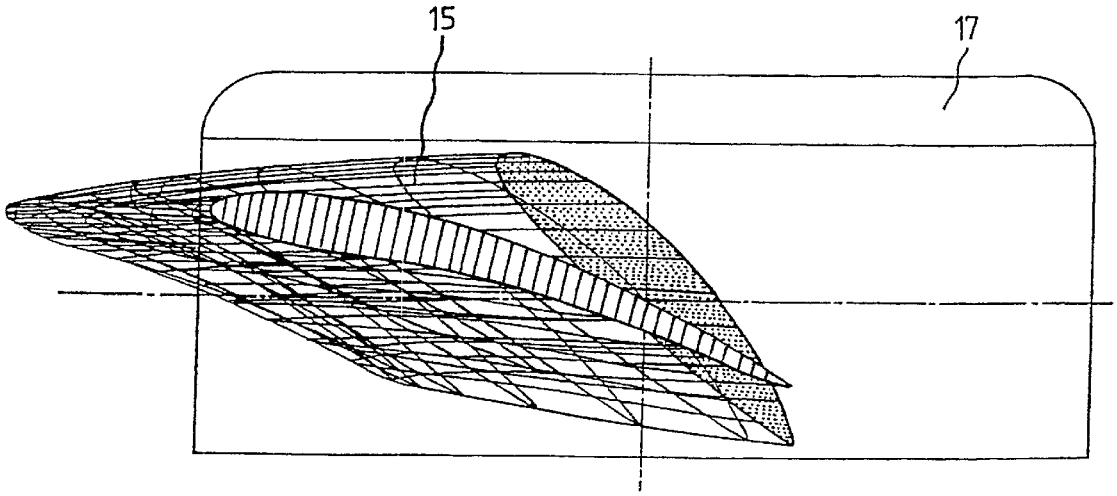
FIG. 6 is a side view of a fin, partly in section.

FIG. 4 is a section through a fin 15; the chord length C and torsion angle $\beta$ are also shown, as is the zx system of coordinates.

Figure 5:
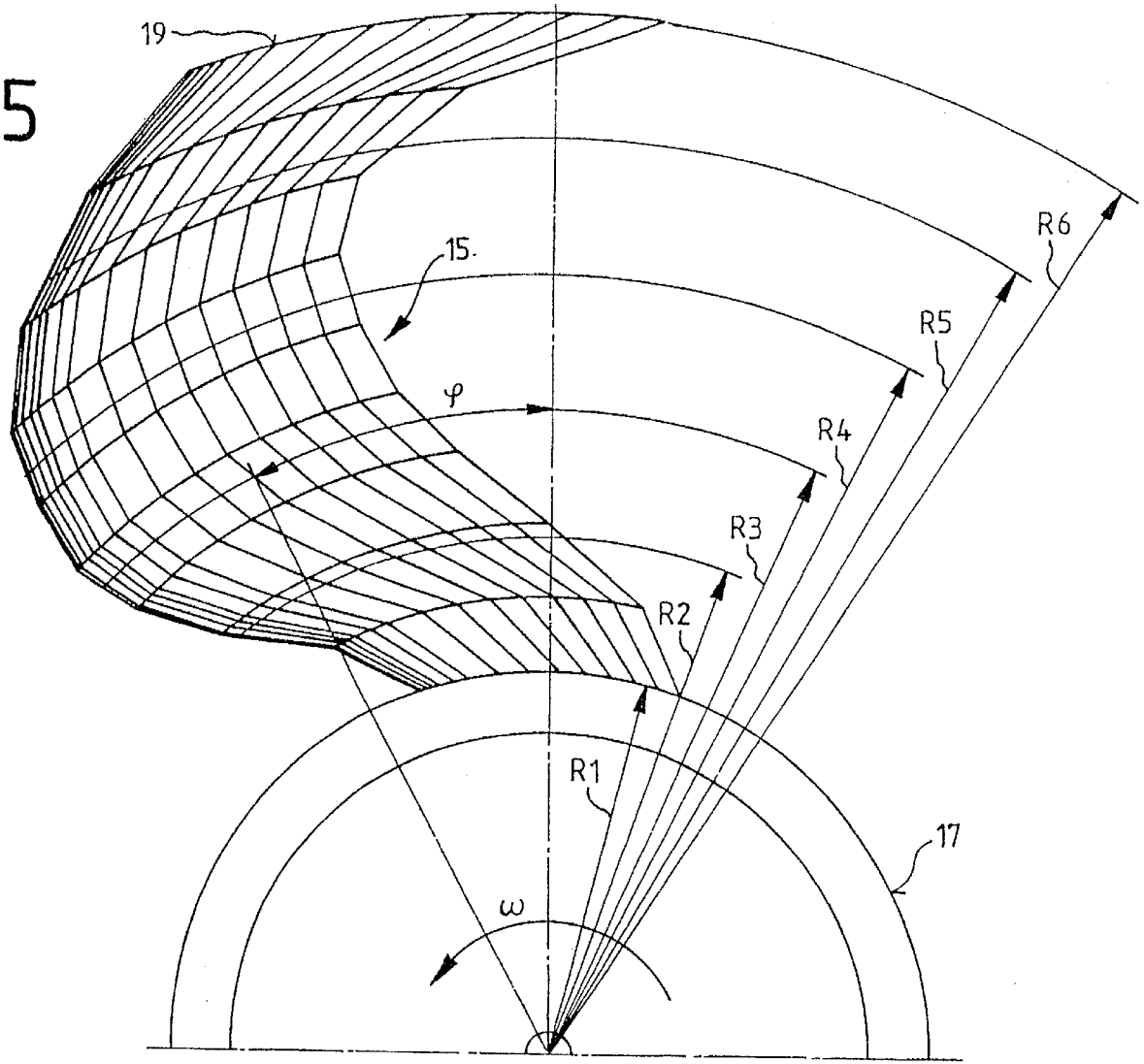
FIG. 5 is a plan view of a fin.

FIG. 5 is a plan view of the hub 17 with one fin 15, showing the sweep or sickle angle $\phi$, the rotary direction $\omega$ of the fan wheel 7 and the individual sections R1 to R6. It will be seen from Table 1 and FIG. 5 that the sickle angle $\phi$ of each particular section of the fin profile increases from the hub 17 to the middle region of the fin, then decreases towards the blade tip 19. In this embodiment the sickle angle is about 0 degrees at the hub 17, about 30 degrees midway along the fin and about 7 degrees at the blade tip 19.

The fins 15 are further characterised in that they are rounded at the leading edges 23. Disturbances in the flow are thus avoided.

It will also be seen from FIGS. 2 and 5 and the example in Table 1 that the chord length C midway along the fins 15 is unchanged. The fins 15 of the axial fan 1 are given by the equations $$YY=CMT(1)+XW*(CMT(2)+XW*(CMT(3)+XW*(CMT(4)+XW*(CMT(5)+XW*(CMT(6)+XW*(CMT(7)+XW*(CMT(8))))))))).$$

In case (A) for the profiles, XW=X, YZ=Z and where X=O Z must equal 0, and in case (B) for the blade parameters, XW=R where R=radius in [mm]

C=chord length of profile section in [mm]

beta ($\beta$)=blade or torsion angle of the profile section in [degrees]

phi ($\phi$)=sickle angle of profile section in [degrees] and

CMT (,)=coefficients of a 7th degree polynomial which have the following polynomial values:

A) For each of the 8 polynomial coefficients/profile

Upper surface:

section: R=R1

CMT(1,1)=0.3376981507E-02

CMT(2,1)=0.1346306419E+01

CMT(3,1)=−0.8917436595E+01

CMT(4,1)=0.3875335108E+02

CMT(5,1)=−0.9757959977E+02

CMT(6,1)=0.1356854384E+03

CMT(7,1)=−0.9721950708E+02

CMT(8,1)=0.2797328941E+02 section: R=R2

CMT(1,2)=0.3442679717E−02

CMT(2,2)=0.1052039458E+01

CMT(3,2)=−0.6847072060E+01

CMT(4,2)=0.2947010493E+02

CMT(5,2)=−0.7402342920E+02

CMT(6,2)=0.1027584038E+03

CMT(7,2)=−0.7349497090E+02

CMT(8,2)=0.2111332593E+02 section: R=R3

CMT(1,3)=0.3549636101E−02

CMT(2,3)=0.1016441804E+01

CMT(3,3)=−0.6641728231E+01

CMT(4,3)=0.2863407070E+02

CMT(5,3)=−0.7196633158E+02

CMT(6,3)=0.9988500889E+02

CMT(7,3)=−0.7139449161E+02

CMT(8,3)=0.2049343126E+02 section: R=R4

CMT(1,4)=0.3549636101E−02

CMT(2,4)=0.1016441804E+01

CMT(3,4)=−0.6641728231E+01

CMT(4,4)=0.2863407070E+02

CMT(5,4)=−0.7196633158E+02

CMT(6,4)=0.9988500889E+02

CMT(7,4)=−0.7139449161E+02

CMT(8,4)=0.204934126E−02 section: R=R5

CMT(1,5)=0.3549636101E−02

CMT(2,5)=0.1016441804E+01

CMT(3,5)=−0.6641728231E+01

CMT(4,5)=0.2863407070E+02

CMT(5,5)=−0.7196633158E+02

CMT(6,5)=0.9988500889E+02

CMT(7,5)=−0.7139449161E+02

CMT(8,5)=0.2049343126E+02 section: R=R6

CMT(1,6)=0.1689076455E−02

CMT(2,6)=0.9040142958E+00

CMT(3,6)=−0.5184480422E+01

CMT(4,6)=0.2125464240E+02

CMT(5,6)=−0.5303796100E+02

CMT(6,6)=0.7405603355E+02

CMT(7,6)=−0.5354340535E+02

CMT(8,6)=0.1558148055E+02

Lower surface section: R=R1

CMT(1,1)=−0.4455810171E−02

CMT(2,1)=−0.9883376876E+00

CMT(3,1)=0.8546841173E+01

CMT(4,1)=−0.3848691771E+02

CMT(5,1)=0.9446865392E+02

CMT(6,1)=−0.1265374123E+03

CMT(7,1)=0.8696017855E+02

CMT(8,1)=−0.2397483370E+02 section: R=R2

CMT(1,2)=−0.3942155380E−02

CMT(2,2)=−0.4834410344E+00

CMT(3,2)=0.4508055654E+01

CMT(4,2)=−0.1760728431E+02

CMT(5,2)=0.3893320149E+02

CMT(6,2)=−0.4931678845E+02

CMT(7,2)=0.3273648169E+02

CMT(8,2)=−0.8762695698E+01 section: R=R3

CMT(1,3)=−0.3864733678E−02

CMT(2,3)=−0.4099249207E+00

CMT(3,3)=0.3873037115E+01

CMT(4,3)=−0.1401815748E+02

CMT(5,3)=0.2908269287E+02

CMT(6,3)=−0.3551685522E+02

CMT(7,3)=0.2305645288E+02

CMT(8,3)=−0.6056502082E+01 section: R=R4

CMT(1,4)=−0.3864733678E−02

CMT(2,4)=−0.4099249207E+00

CMT(3,4)=0.3873037115E+01

CMT(4,4)=−0.1401815748E+02
CMT(5,4)=0.2908269287E+02
CMT(6,4)=−0.3551685522E+02
CMT(7,4)=0.2305645288E+02
CMT(8,4)=−0.6056502082E+01
section: R=R5
CMT(1,5)=−0.3864733678E−02
CMT(2,5)=−0.4099249207E+00
CMT(3,5)=0.3873037115E+01
CMT(4,5)=−0.1401815748E+02
CMT(5,5)=0.2908269287E+02
CMT(6,5)=−0.3551685522E+02
CMT(7,5)=0.2305645288E+02
CMT(8,5)=−0.6056502082E+01
section: R=R6
CMT(1,6)=−0.4887062523E−02
CMT(2,6)=−0.5286422060E+00
CMT(3,6)=0.5627445225E+01
CMT(4,6)=−0.2588377237E+02
CMT(5,6)=0.6274982578E+02
CMT(6,6)=−0.8239775694E+02
CMT(7,6)=0.5528493619E+02
CMT(8,6)=−0.1484426302E+02

B) For each of the 8 polynomial coefficients/blade parameter
7) Blade or torsion beta:
CMT(1,7)=−0.4697250995E+03
CMT(2,7)=0.4001478271E+04
CMT(3,7)=−0.1253658651E+05
CMT(4,7)=0.2086825208E+05
CMT(5,7)=−0.2033489916E+05
CMT(6,7)=0.1167684995E+05
CMT(7,7)=−0.3668617885E+04
CMT(8,7)=0.4871535274E+03
8) Chord or blade depth C:
CMT(1,8)=0.2408300635E+04
CMT(2,8)=−0.1817445567E+05
CMT(3,8)=0.5795282668E+05
CMT(4,8)=−0.9923492684E+05
CMT(5,8)=0.9886067448E+05
CMT(6,8)=−0.5738949094E+05
CMT(7,8)=0.1797957997E+05
CMT(8,8)=−0.2342597340E+04
9) Sickle or staggering angle phi:
CMT(1,9)=0.2385695864E+04
CMT(2,9)=−0.1598239118E+05
CMT(3,9)=0.4314926438E+05
CMT(4,9)=−0.6077259038E+05
CMT(5,9)=0.4810934463E+05
CMT(6,9)=−0.2104994947E+05
CMT(7,9)=0.4509133500E+04
CMT(8,9)=−0.3190222506E+03.

Figure 7:
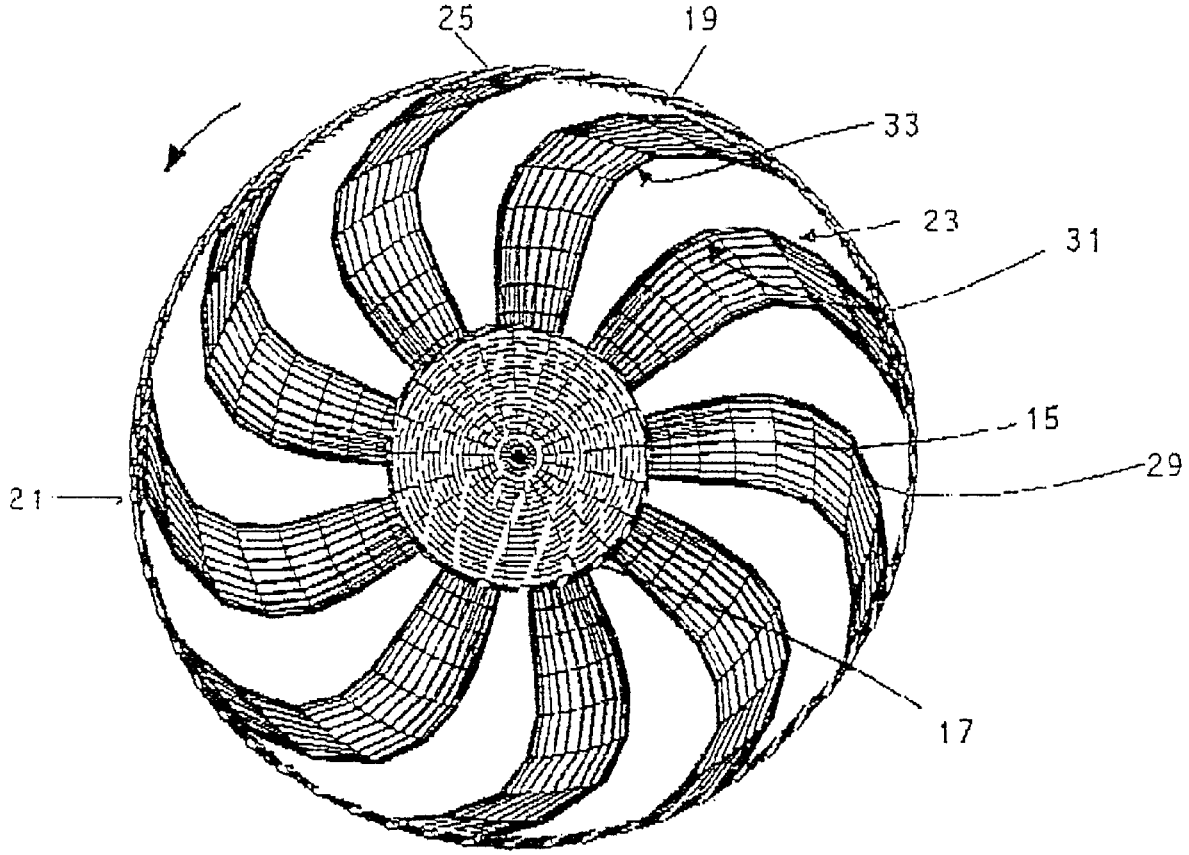
FIG. 7 is a plan view of a second embodiment of the invention.

FIG. 7 shows a plan view in an arrangement similar to FIG. 2. To be seen are the fan wheel 7 in plan; the inner ends of its sickle-shaped or crescent-shaped fins 15 are fixed to a hub 17 driven by an electric motor, and the tips 19 of the fins are fixed to a jacket or surrounding ring 21 arranged concentrically with the hub 17.

The leading edges 23 and trailing edges 25 of the three-dimensional fins each have a strong backward sweep 29 and a straight leading and trailing edge near the hub 27. The transitions from the forward sweep 27 to the straight plan form of the fins are formed in their central regions by constant azimuthal displacements. These reliefs of the sweeps ensure that rolling-up or coiling eddies at the leading edges 23 are avoided.

In an advantageous embodiment the transitions comprise cubic splines 31 and 33. It will also be seen from FIG. 7 and Table 2 below that the chord length C of the fin profiles is shorter in the region of the hub 17 than at the tips 19 of the fin blades. The blade or torsion angle beta in the vicinity of the tips 19. Thus the blade or torsion angle beta at the root of the blade or the hub 17 may, for example, be approximately 42 degrees, while the torsion angle β at the blade tips 19 is approximately 16 degrees.

The coefficients of the second embodiment are given in the same manner as above for the first embodiment. They are here the same with respect to the "section" coefficients but differ with respect to B). They are as follows:

A) For each of the 8 polynomial coefficients/profile
Upper surface:
section: R=R1
CMT(1,1)=0.337698507E−02
CMT(2,1)=0.1346306419E+01
CMT(3,1)=−0.8917436595E+01
CMT(4,1)=0.3875335108E+02
CMT(5,1)=−0.9757959977E+02
CMT(6,1)=0.1356854384E+03
CMT(7,)=−0.9721950708E+02
CMT(8,1)=0.2797328941E+02
section: R=R2
CMT(1,2)=0.3442679717E−02
CMT(2,2)=0.1052039458E+01
CMT(3,2)=−0.6847072060E+01
CMT(4,2)=0.2947010493E+02
CMT(5,2)=−0.7402342920E+02
CMT(6,2)=0.1027584038E+03
CMT(7,2)=−0.7349497090E+02
CMT(8,2)=0.2111332593E+02
section: R=R3
CMT(1,3)=0.3549636101E−02
CMT(2,3)=0.1016441804E+01
CMT(3,3)=−0.6641728231E+01
CMT(4,3)=0.2863407070E+02
CMT(5,3)=−0.7196633158E+02
CMT(6,3)=0.9988500889E+02
CMT(7,3)=−0.7139449161E+02
CMT(8,3)=0.2049343126E+02
section: R=R4
CMT(1,4)=0.3549636101E−02
CMT(2,4)=0.1016441804E+01
CMT(3,4)=−0.6641728231E+01
CMT(4,4)=0.2863407070E+02
CMT(5,4)=−0.7196633158E+02
CMT(6,4)=0.9988500889E+02
CMT(7,4)=−0.7139449161E+02
CMT(8,4)=0.2049343126E−02
section: R=R5
CMT(1,5)=0.3549636101E−02
CMT(2,5)=0.1016441804E+01
CMT(3,5)=−0.6641728231E+01

CMT(4,5)=0.2863407070E+02
CMT(5,5)=−0.7196633158E+02
CMT(6,5)=0.9988500889E+02
CMT(7,5)=−0.7139449161E+02
CMT(8,5)=0.2049343126E+02
section: R=R6
CMT(1,6)=0.1689076455E−02
CMT(2,6)=0.9040142958E+00
CMT(3,6)=−0.5184480422E+01
CMT(4,6)=0.2125464240E+02
CMT(5,6)=−0.5303796100E+02
CMT(6,6)=0.7405603355E+02
CMT(7,6)=−0.5354340535E+02
CMT(8,6)=0.1558148055E+02
Lower surface
section: R=R1
CMT(1,1)=−0.4455810171E−02
CMT(2,1)=−0.9883376876E+00
CMT(3,1)=0.8546841173E+01
CMT(4,1)=−0.3848691771E+02
CMT(5,1)=0.9446865392E+02
CMT(6,1)=−0.1265374123E+03
CMT(7,1)=0.8696017855E+02
CMT(8,1)=−0.2397483370E+02
section R=R2
CMT(1,2)=−0.3942155380E−02
CMT(2,2)=−0.4834410344E+00
CMT(3,2)=0.4508055654E+01
CMT(4,2)=−0.1760728431E+02
CMT(5,2)=0.3893320149E+02
CMT(6,2)=−0.4931678845E+02
CMT(7,2)=0.3273648169E+02
CMT(8,2)=−0.8762695698E+01
section: R=R3
CMT(1,3)=−0.3864733678E−02
CMT(2,3)=−0.4099249207E+00
CMT(3,3)=0.3873037115E+01
CMT(4,3)=−0.1401815748E+02
CMT(5,3)=0.2908269287E+02
CMT(6,3)=−0.3551685522E+02
CMT(7,3)=0.2305645288E+02
CMT(8,3)=−0.6056502082E+01
section: R=R4
CMT(1,4)=−0.3864733678E−02
CMT(2,4)=−0.4099249207E+00
CMT(3,4)=0.3873037115E+01
CMT(4,4)=−0.1401815748E+02
CMT(5,4)=0.2908269287E+02
CMT(6,4)=−0.3551685522E+02
CMT(7,4)=0.2305645288E+02
CMT(8,4)=−0.6056502082E+01
section: R=R5
CMT(1,5)=−0.3864733678E−02
CMT(2,5)=−0.4099249207E+00
CMT(3,5)=0.3873037115E+01
CMT(4,5)=−0.1401815748E+02
CMT(5,5)=0.2908269287E+02
CMT(6,5)=−0.3551685522E+02
CMT(7,5)=0.2305645288E+02
CMT(8,5)=−0.6056502082E+01
section: R=R6
CMT(1,6)=−0.4887062523E−02
CMT(2,6)=−0.5286422060E+00
CMT(3,6)=0.5627445225E+01
CMT(4,6)=−0.2588377237E+02
CMT(5,6)=0.6274982578E+02
CMT(6,6)=−0.8239775694E+02
CMT(7,6)=0.5528493619E+02
CMT(8,6)=−0.1484426302E+02

B) For each of the 8 polynomial coefficients/blade parameter

7) Blade or torsion beta:
CMT(1,7)=−0.6103135302E+03
CMT(2,7)=0.7667618964E+04
CMT(3,7)=−0.3598438393E+05
CMT(4,7)=0.8985974924E+05
CMT(5,7)=−0.1313038901E+06
CMT(6,7)=0.1129607737E+06
CMT(7,7)=−0.5312937044E+05
CMT(8,7)=0.1055613653E+05

8) Chord or blade depth C:
CMT(1,8)=−0.4182636598E+00
CMT(2,8)=0.0121596258E+01
CMT(3,8)=−0.4157539857E+02
CMT(4,8)=0.1168384817E+03
CMT(5,8)=−0.1929718491E+03
CMT(6,8)=0.1871832365E+03
CMT(7,8)=−0.9875050665E+02
CMT(8,8)=0.2187070492E+02

9) Sickle or staggering angle phi:
CMT(1,9)=−0.4674725480E+02
CMT(2,9)=0.5901463580E+03
CMT(3,9)=−0.3058152755E+04
CMT(4,9)=0.8586543503E+04
CMT(5,9)=−0.1412185381E+05
CMT(6,9)=0.1361649372E+05
CMT(7,9)=−0.7131065142E+04
CMT(8,9)=0.1563659336E+04

The method of making the fins 15 is as follows. The z values for the individual profile sections relating to the x values are first determined, separately for their upper and lower surfaces, with the aid of the polynomial coefficients CMT and the polynomial $$Y = \sum_{i=1}^{8} C_i X^{i-1}$$

The torsion angles β, chord length C and sickle angle ϕ for each profile are next calculated at the locations of the individual radii. The x and z coordinates of the profiles are multiplied by C to obtain the actual blade dimensions. Then each profile is rotated about the profile nose through the blade or torsion angle β. Each section is thereupon displaced azimuthally through the sickle angle ϕ, thus giving the blade its low-noise sickle shape. The centre of rotation for the displacement is the centre of the fan wheel 7.

It will be understood that the above description of the present invention is susceptible to various modifications, changes and adaptations.

EXAMPLE

TABLE 1

| Section no: | 1 | 2 | 3 | 4 | 5 |
|---|---|---|---|---|---|
| R mm | 55.0 | 65.6 | 76.1 | 86.7 | 97.2 |
| C mm | 52.9 | 57.4 | 60.0 | 60.0 | 60.0 |
| beta ° | 43.50 | 37.27 | 31.81 | 27.68 | 24.58 |
| phi ° | −0.15 | 8.54 | 19.80 | 26.40 | 29.39 |
| Section no: | 6 | 7 | 8 | 9 | 10 |
| R mm | 107.8 | 118.3 | 128.9 | 139.4 | 150.0 |
| C mm | 60.0 | 60.0 | 60.0 | 63.01 | 76.50 |
| beta ° | 22.22 | 20.36 | 18.97 | 17.80 | 16.80 |
| phi ° | 29.56 | 28.75 | 25.08 | 17.42 | 7.02 |

R = radius
C = chord length of the particular section
beta = blade or torsion angle of the particular section
phi = sickle angle of the particular section

EXAMPLE

TABLE 2

| CUT | 1 | 2 | 3 | 4 | 5 |
|---|---|---|---|---|---|
| R / RT | 0.32 | 0.43 | 0.49 | 0.56 | 0.62 |
| C / RT | 0.26 | 0.27 | 0.27 | 0.27 | 0.26 |
| beta ° | 51.8 | 41.8 | 36.2 | 31.8 | 28.2 |
| phi ° | 0.0 | 0.0 | 0.0 | 0.0 | −0.5 |
| CUT | 6 | 7 | 8 | 9 | 10 |
| R / RT | 0.74 | 0.80 | 0.86 | 0.92 | 1.00 |
| C / RT | 0.8 | 0.29 | 0.29 | 0.29 | 0.30 |
| beta ° | 23.1 | 21.1 | 19.5 | 18.0 | 16.30 |
| phi ° | −2.4 | −5.3 | −8.9 | −16.8 | −27.0 |

R = radius
C = chord length of the particular section
beta = blade or torsion angle of the particular section
phi = sickle angle of the particular section

What is claimed is:

1. An axial fan comprising a fan wheel with fins with inner and outer ends, and leading and trailing edges, the inner ends of said fins being fixed to a hub and the outer ends of the fins being fixed to a surrounding ring arranged concentrically with said hub, wherein the leading edges and trailing edges of the fins each have a forward sweep portion extending from the hub and into a flow of fluid followed by a relatively straight transition portion that is followed by a backward sweep portion extending from the forward sweep to the ring and away from the flow of fluid.

2. An axial fan according to claim 1, wherein said transition portion for each fin is formed between the forward sweep portion and the backward sweep portion at the leading edges and trailing edges of the fins, said transition portions being formed in a central region of the fins by a constant azimuthal displacement between the central region of the fins and outer regions of the fins, said outer regions of the fins being along said leading and trailing edges of the fins.

3. An axial fan according to claim 1 wherein the fins have profiles defining a chord length, the chord length being shorter adjacent the hub than the chord length at the outer ends of the fins.

4. An axial fan according to claim 3, wherein the chord length in a middle region of the fins is constant.

5. An axial fan according to claim 1, wherein the fins define a torsion angle, said torsion angle being larger adjacent the hub than adjacent the outer ends of the fins.

6. An axial fan according to claim 5, wherein the torsion angle is between about 45° at the inner end of the fins, and about 15° at the outer ends of the fins.

7. An axial fan according to claim 1, wherein each particular section of a fin profile defines a sickle angle, said sickle angle increasing from the hub to the middle region of a fin, then decreasing towards the outer end of the fin.

8. An axial fan according to claim 7, wherein the sickle angle is about 0° at the hub, about 30° midway along the fin and about 7° at the outer end.

9. An axial fan according to claim 1 wherein the fins are rounded at their leading edges.

10. An axial fan comprising a fan wheel with fins with inner and outer ends, and leading and trailing edges, the inner ends of said fins being fixed to a hub and the outer ends of the fins being fixed to a surrounding ring arranged concentrically with said hub, wherein the leading edges and trailing edges of the fins each have a straight portion near the hub followed by a backward sweep extending from the straight portion to the ring and away from a flow of fluid.

11. An axial fan according to claim 10, wherein a transition for each fin is formed between the straight portion and the backward sweep at the leading edge and trailing edge of the fin, said transitions being formed in a central region of the fins by a constant azimuthal displacement between the central region of the fins and outer regions of the fins, said outer regions of the fins being along said leading and trailing edges of the fins.

12. An axial fan according to claim 10 wherein the fins have profiles defining a chord length, the chord length being shorter adjacent the hub than the chord length at the outer ends of the fins.

13. An axial fan according to claim 12, wherein the chord length in a middle region of the fins is constant.

14. An axial fan according to claim 10, wherein the fins define a torsion angle, said torsion angle being larger adjacent the hub than adjacent the outer ends of the fins.

15. An axial fan according to claim 14, wherein the torsion angle is between about 42° at the inner end of the fins, and about 16° at the outer ends of the fins.

16. An axial fan according to claim 10, wherein each particular section of a fin profile defines a sickle angle, said sickle angle increasing from the hub to a middle region of the fin, then decreasing towards the outer end of the fin.

17. An axial fan according to claim 16, wherein the sickle angle is about 0° at the hub, about 30° midway along the fin and about 7° at the outer end.

18. An axial fan according to claim 10 wherein the fins are rounded at their leading edges.

* * * * *